US005235886A

United States Patent [19]

Jurus

[11] Patent Number: 5,235,886

[45] Date of Patent: Aug. 17, 1993

[54] APPARATUS FOR MANUFACTURE OF VEHICLE WHEELS

[75] Inventor: Kevin D. Jurus, Lansing, Mich.

[73] Assignee: Motor Wheel Corp.

[21] Appl. No.: 863,021

[22] Filed: May 20, 1992

[51] Int. Cl.[5] ..... B21D 53/26

[52] U.S. Cl. ..... 83/182; 29/894.325; 83/466; 279/126

[58] Field of Search ..... 279/123, 126, 114, 121; 83/182, 458, 466; 72/335, 327; 29/894.325, 894.32

[56] References Cited

U.S. PATENT DOCUMENTS

| | | | |
|---|---|---|---|
| 1,642,508 | 9/1927 | Robinson | 269/26 |
| 2,253,713 | 8/1941 | Lancaster | 144/289 |
| 2,682,908 | 7/1954 | Schultz | 154/1 |
| 3,263,477 | 8/1966 | Roper | 72/401 |
| 3,420,148 | 1/1969 | Doerfer et al. | 92/107 |
| 3,427,015 | 2/1969 | Ohrnberger | 269/25 |
| 3,491,996 | 1/1970 | Ohrnberger | 269/25 |
| 3,530,717 | 9/1970 | Gregg | 72/354 |
| 3,868,101 | 2/1975 | Nozaki et al. | 269/25 |
| 3,868,102 | 2/1975 | Pevar | 269/26 |
| 4,254,676 | 3/1981 | Wilson | 279/126 X |
| 4,279,287 | 7/1981 | Daudi et al. | 152/375 |
| 4,354,407 | 10/1982 | Daudi et al. | 83/55 |
| 4,391,120 | 7/1983 | Trevarrow | 72/403 |
| 4,536,000 | 8/1985 | Röhm | 279/126 |
| 4,573,338 | 4/1986 | Daudi | 72/333 |
| 4,669,161 | 6/1987 | Sekelsky, Jr. | 29/33 P |
| 4,736,611 | 4/1988 | Daudi | 72/327 |
| 4,790,545 | 12/1988 | Dzewaltowski | 279/126 |
| 4,819,472 | 4/1989 | Daudi | 72/335 |
| 5,108,117 | 4/1992 | Crossman et al. | 279/126 |

*Primary Examiner*—Douglas D. Watts
*Assistant Examiner*—Kenneth E. Peterson
*Attorney, Agent, or Firm*—Barnes, Kisselle, Raisch, Choate, Whittemore & Hulbert

[57] ABSTRACT

Apparatus for forming at least one mounting opening in a vehicle wheel that includes a circumferential array of locating jaws movable between an outer position and an inner position radially inward of the outer position in which the locating jaws engage the rim portion of the wheel positioned within the locating jaws. An upper die is reciprocable for forming at least one mounting opening on a first axis in the disc portion of a wheel engaged by the locating jaws. Position sensors are operatively coupled to the locating jaws for providing electrical sensor signals as a function of position of the locator jaws relative to the axis of the mounting openings formed in the wheel. The sensors are coupled to electronics for indicating position of the locator jaws relative to such axis. The electronics responsive to the several positions sensor signals include facility for computing the average axis of the bead seat locator jaws relative to the axis of the mounting-opening tooling based upon the locator jaw position signals from the several sensors. The average locator jaw axis position so measured may be compared to a desired bead seat locator jaw axis, which may be either concentric with or eccentric to the axis of the mounting-opening tooling. Any difference therebetween is displayed to an operator to facilitate adjustment of the individual locator jaws.

13 Claims, 3 Drawing Sheets

APPARATUS FOR MANUFACTURE OF VEHICLE WHEELS

The present invention relates to the art of vehicle wheel manufacture, and more particularly to an apparatus for forming mounting openings in the disc of a vehicle wheel at desired concentricity or eccentricity with respect to the wheel rim bead seats.

BACKGROUND OF THE INVENTION

A problem long-standing in the automotive field lies in production of pneumatic tire and wheel assemblies that, when assembled and operated on a vehicle, run true about their axis of rotation. Forces generated by any circumferential variations in the tire carcass and/or out-of-round condition in the tire or wheel causes vibrations, which in turn lead to dissatisfied customers and significant warranty claims against automobile manufacturers. The present trend among manufacturers toward higher tire inflation pressures, smaller vehicles and tighter vehicle suspensions to improve fuel economy accentuates this problem, so that uniformity of radial run-out and force variations of the tire and wheel assembly has become more critical than in the past.

Vehicle wheels conventionally include a circular array of disc bolt openings adapted to receive studs for fastening the wheel to a vehicle, and a center-pilot opening adapted to be received over the wheel hub. It has been and remains conventional practice in the industry to attempt to form the bolt circle and center-pilot openings coaxially with each other and with the rim bead seats, with the goal thus being a perfect true-running wheel. A number of techniques have been proposed for accomplishing this result, including formation of the bolt and center openings with a single tool while locating off of the bead seats, machining the center opening while locating off of preformed bolt openings, and/or circumferentially permanently deforming the rim bead seats while locating off of the bolt and/or center-pilot opening.

Daudi et al U.S. Pat. Nos. 4,279,287, 4,354,407 and 4,573,338 all assigned to the assignee hereof and incorporated by reference herein, depart from the conventional practice of attempting to form a true-running wheel, and address the problem of radial run-out and/or radial force variation in a pneumatic tire and wheel assembly by intentionally forming the bolt openings and/or center-pilot opening in the wheel disc at the time of wheel manufacture on an axis that is eccentric to the average axis of the rim bead seats. (It is understood in the art that the average axis of the bead seats is the average axis of one bead seat averaged with the average axis of the other bead seat, for example by measuring the bead seats simultaneously.) This eccentricity is in a direction and amount that is predetermined to locate the low point or high point of the first harmonic of bead seat radial run-out circumferentially adjacent to a selected location on the wheel rim. In the preferred embodiments, the low point of the first harmonic of bead seat radial run-out lies substantially within a quadrant centered on the valve stem opening in the rim. A pretested tire having the location of the high point of the first harmonic of radial force variation marked thereon may then be assembled to the wheel with tire mark aligned with wheel valve stem opening so that the respective tire and wheel harmonics are complimentary and thereby tend to cancel each other.

In the preferred wheel forming apparatus disclosed in the above-noted Daudi et al U.S. Patents, the bolt and center-pilot openings are formed by separate punches fixedly mounted on a single punch assembly that substantially simultaneously punch-forms all the mounting openings in a wheel disc while the wheel is located by fixturing the same about the rim bead seats. Daudi U.S. Pat. Nos. 4,736,611 and 4,819,472, also incorporated by reference herein, disclose a modified method and apparatus for forming the bolt and center-pilot openings in which a preformed wheel is engaged and fixtured around the rim bead seats with the inboard disc face resting on a lower die assembly and without plastic deformation to the rim or disc. An upper die assembly having an array of bolt hole punches is moved into piercing and coining engagement with the disc to form the bolt openings. Continued motion of the upper die assembly pushes the disc and lower die assembly into shearing engagement with a center punch that forms the center-pilot opening. The axis of the bolt openings and/or center-pilot opening and/or bead seats may be concentric with or eccentric to each other.

A problem with the apparatus disclosed in the above-noted patents lies in the fact that the several locators that engage the rim bead seats, which collectively define the location of the average bead seat axis of the wheel relative to the tooling set-up during the forming operation, require individual adjustment by relatively skilled technicians. Whether forming the mounting openings (i.e., the bolt openings and/or the center-pilot opening) concentric with or eccentric to the rim bead seats, it is desirable that the array of bead-seat-engaging surfaces of the locating jaws be substantially concentric with each other when engaging the rim bead seats during the forming operation. Added to this, of course, is the complexity of adjusting the individual locating jaws so that their average axis is either precisely concentric with the hole-forming mechanism, or eccentric thereto by a precise and desired amount. The current practice is to adjust the several jaws with respect to a centrally located gauge to positions believed to locate the average bead seat axis at the desired position, run a representative sample such as five wheels through the apparatus, and measure position of the average bead seat axis relative to the bolt and/or center-pilot mounting openings. If the measured bead seat axis is not at the desired location with desired statistical consistency, individual locating jaws are adjusted in an attempt to improve position and/or statistical consistency of the bead seat axis location. The jaws to be adjusted and the amount of adjustment to each jaw are empirically determined by the technician based upon training and experience. The entire process is repeated until the average axis of the bead seats in wheels produced by the apparatus is at the desired location with the desired statistical consistency.

It is a general object of the present invention to provide improved apparatus for forming mounting openings in vehicle wheels having facility for easy, more precise and economical adjustment of concentricity/eccentricity of the mounting openings with respect to the rim bead seats.

SUMMARY OF THE INVENTION

The present invention is directed to apparatus for forming at least one mounting opening—i.e., the bolt openings and/or the center-pilot opening—in a vehicle wheel that includes a rim portion and a disc portion that internally spans the rim portion for mounting the wheel to a vehicle. The apparatus includes a circumferential array or series of locating jaws for engaging and locating the rim portion of the wheel, preferably by engaging one or both of the rim bead seats. The locating jaws are movable between a first or outer position, and a second or inner position radially inward of the outer position and in which the locating jaws engage the rim portion of the wheel positioned within the locating jaws. An upper die is reciprocable for forming at least one mounting opening on a first axis in the disc portion of a wheel engaged by the locating jaws. Preferably, the bolt openings are formed by punches carried by the upper die, and the center-pilot opening may be likewise formed by a punch carried by the upper die or by an opposing punch carried by the lower die. A position sensor is operatively coupled to at least one, and preferably all, of the locating jaws for providing an electrical sensor signal as a function of position of the locator jaws relative to the axis of the mounting openings formed in the wheel. The sensors are coupled to electronics for indicating position of the locator jaws relative to such axis.

In the preferred embodiment of the invention, the electronics responsive to the several positions sensor signals include facility for computing the average axis of the bead seat locator jaws relative to the axis of the mounting-opening tooling based upon the locator jaw position signals from the several sensors. The average locator jaw axis position so measured may be compared to a desired bead seat locator jaw axis, which may be either concentric with or eccentric to the axis of the mounting-opening tooling. Any difference therebetween is displayed to an operator to facilitate adjustment of the individual locator jaws. Most preferably, the electronics includes facility for computing and selectively displaying adjustment needed at each individual jaw needed to position that jaw on a circle centered on the desired axis of all bead seat locator jaws. Further, such display is directly responsive to bead seat locator jaw position during the adjustment operation so as to indicate to the operator when the necessary adjustment of that jaw has been completed. Thus, the operator may display and implement necessary adjustment on each locator jaw in sequence.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
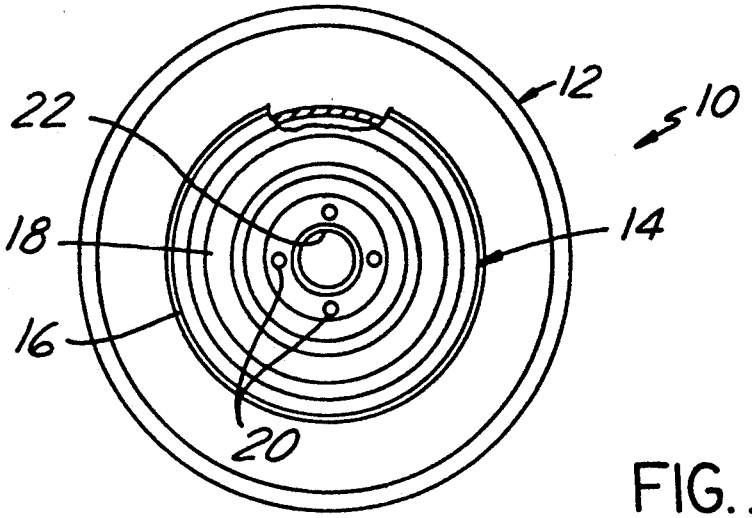
FIG. 1 is a fragmentary outboard elevational view of a vehicle tire and wheel assembly that includes a vehicle wheel manufactured in accordance with the present invention.

FIG. 1 illustrates a pneumatic tire and wheel assembly 10 as comprising a pneumatic tire 12 mounted on a wheel 14. Wheel 14 includes a rim portion 16 having axial spaced outboard and inboard bead seats on which the toes of tire 12 are mounted, and a disc portion 18 affixed to and positioned within rim 16. Disc 18 has a circular array of bolt openings 20 surrounding a center-pilot opening 22. The wheel 14 illustrated in FIG. 1 is a so-called stamped steel wheel of the type in which the rim and disc portions are separately formed from steel sheet stock, and are assembled to each other to form the wheel. It will be recognized as the description unfolds, however, that the invention in its broadest aspects is by no means limited specifically to manufacture of stamped steel wheels, but may be employed for forming mounting openings by drilling, boring, reaming or the like in cast, forged or wrought aluminum wheels, molded fiber/resin composite wheels, etc. Likewise, although the invention is illustrated in conjunction with a wheel of geometry suitable for rear-wheel drive vehicles, it will be recognized that the invention may be employed with equal facility in conjunction with wheels for front-wheel drive vehicles in which the central portion of the disc is disposed more outboard of the rim center plane. Thus, the specific wheel construction and geometry shown in the drawings are for illustrative purposes only.

Figure 2:
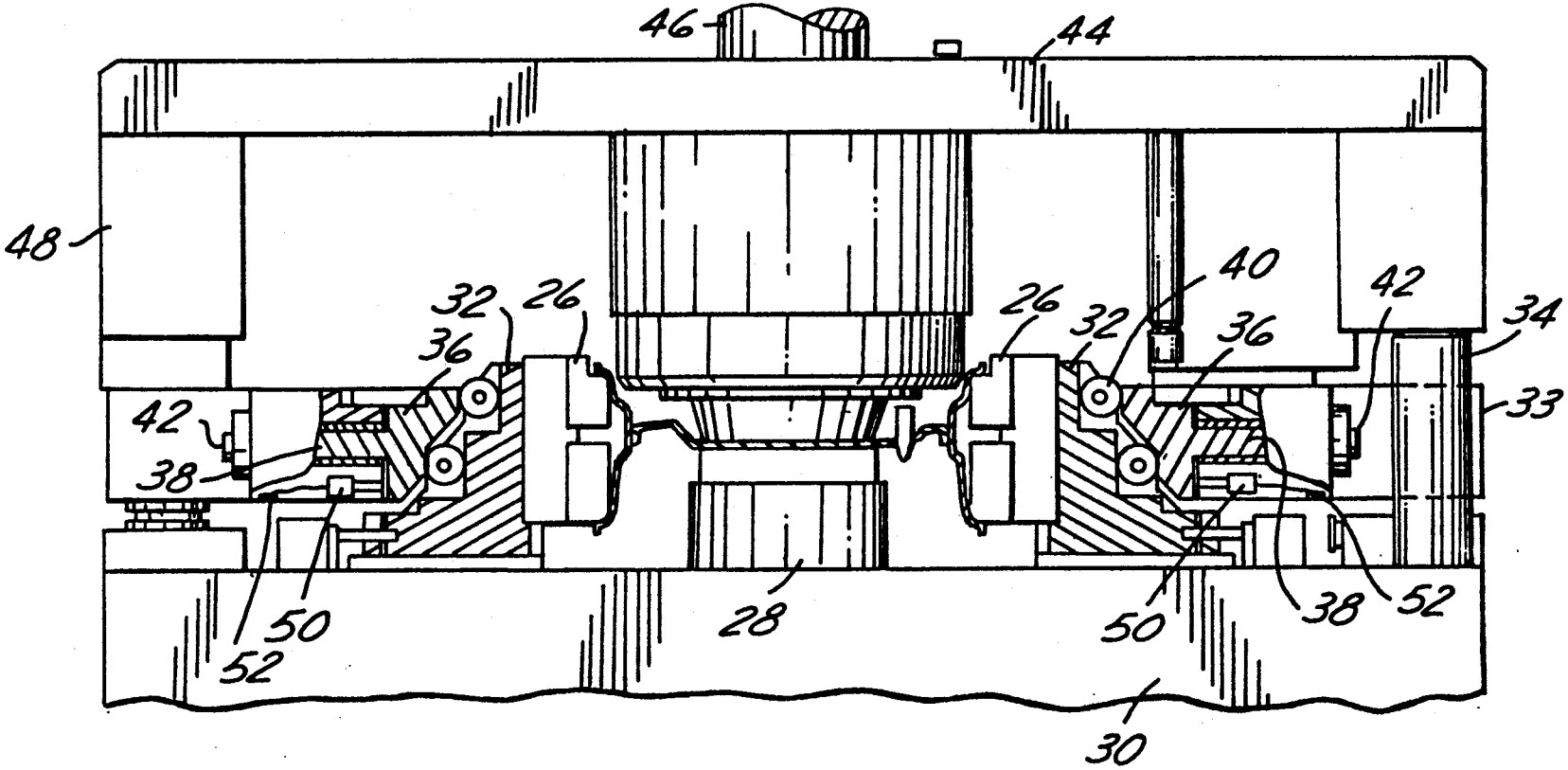
FIG. 2 is a fragmentary elevational view bisecting apparatus for forming mounting openings in a vehicle wheel in accordance with a presently preferred embodiment of the invention.

FIG. 2 illustrates one apparatus 24 for implementation of the present invention. A plurality of wheel locating and fixturing jaws 26 are disposed in a circumferential array surrounding a lower die 28 carried by a die base 30. Each of the locator jaws 26 is mounted on an associated slide 32 carried by base 30 for movement radially inwardly and outwardly with respect to die 28. A circumferentially continuous actuator ring 33 is axially slidably carried by a circumferential array of fixed guide posts 34 that project upwardly from lower die base 30. A plurality of circumferentially spaced actuator camming blocks 36 have shanks 38 radially slidably carried by ring 33, with blocks 36 projecting inwardly from the inner diameter of ring 33 in alignment with rollers 40 carried by respective slides 32. The position of each cam block 36 is independently adjustable radially of cam ring 33 by means of an adjustment screw 42 threadably received in each shank 37. Screws 42 thus adjust position of associated slides 32 and jaws 26 in the closed position of apparatus 24 illustrated in FIG. 2.

An upper die 44 carries a plurality of punches for punching and coining bolt openings 20 (FIG. 1) in disc 18, and a center punch for punching or forming the center-pilot opening 22 of disc 18. Upper die 44 is coupled to a ram 46 for reciprocating the upper die downwardly and upwardly with respect to lower die 28 and die base 30. Upper die 44 is guided by the sleeves 48 slidably received over guide posts 34 on base 30. Each cam block 36 has a pair of angulated or ramped lower inside cam surfaces for engaging a corresponding roller 40 on slides 32 and urging the associated slide and jaw 26 radially inwardly as ring 33 is moved downwardly by abutment with upper die 44 as the upper die descends. To the extent thus far described, apparatus 24 is disclosed in above-noted U.S. Pat. Nos. 4,279,287 and 4,354,407, and in U.S. Pat. Nos. 4,736,611 and 4,819,472 in which the center punch is disposed on lower die 28.

Reference may be made to these patents for further details of structure and operation.

Figure 3:
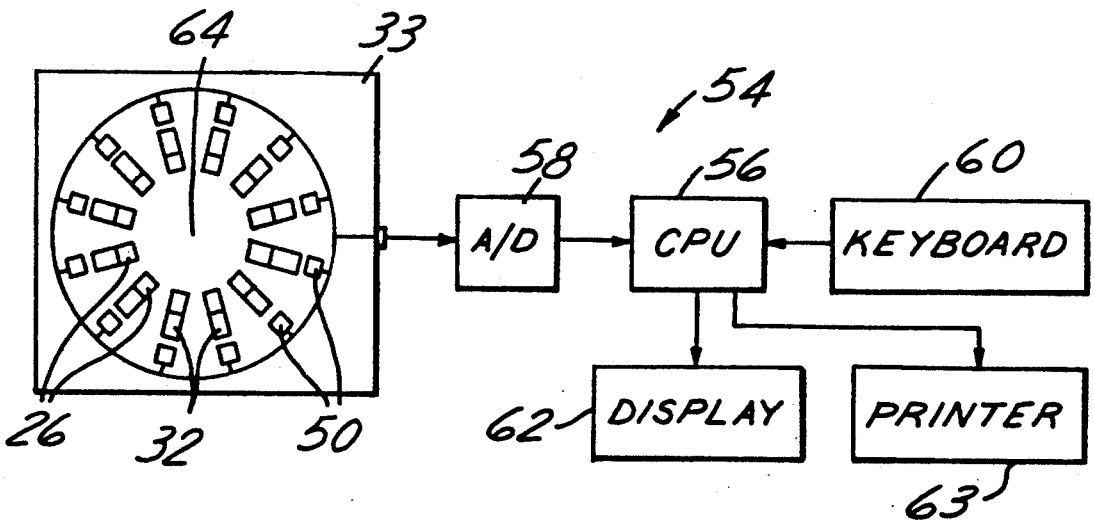
FIG. 3 is a schematic and functional block diagram of the electronics for facilitating adjustment of the apparatus in accordance with a presently preferred embodiment of the invention.

A plurality of sensors 50 are mounted on actuator ring 33 at positions radially outwardly adjacent to individual associated cam blocks 36. Each sensor 50 comprises a proximity sensor that provides an electrical d.c. sensor signal as a linear function of radial proximity of the associated cam block 36 relative to ring 33. Thus, each sensor 50 provides an electrical output signal that varies as a function of radial adjustment of the associated cam block 36 relative to ring 33 by means of screw 42. The several sensors 50 have leads that extend through a channel 52 formed on the underside of ring 33 to measurement and display electronics 54 illustrated in FIG. 3. Electronics 54 include a central processing unit or CPU 56 for selectively sampling the outputs from sensors 50 through an a/d converter 58, and for storing the sampled position signals in memory. CPU 56 also receives inputs from an operator keyboard 60, and provides outputs to an operator display 62 such as a CRT. CPU 56 may also be connected to a printer 63 for generation of quality reports and the like.

In operation, it will be recognized that the outboard surfaces of the individual cam blocks 32 adjacent to the associated position sensors 50 are related to position of the locator jaws 26 by means of a fixed mechanical distance measured in the radial direction. Thus, sensing the position of the outboard surfaces of the cam blocks 32 relative to the cam ring 33 by the plurality of sensors 50 provides an indication of radial position of the associated bead seat-engaging jaws 26 relative to the axis 64 (FIG. 3) of upper die 44. Thus, by monitoring position of locator jaws 26 individually and collectively, CPU 56 can determine not only the average axis of jaws 26 when they collectively engage the bead seats, but also the direction and amount of adjustment needed to the individual jaws by means of the associated screws 42 to position the average axis of the locator jaws at a desired position either concentric with or eccentric to axis 64 of the punch tooling.

Figure 4:
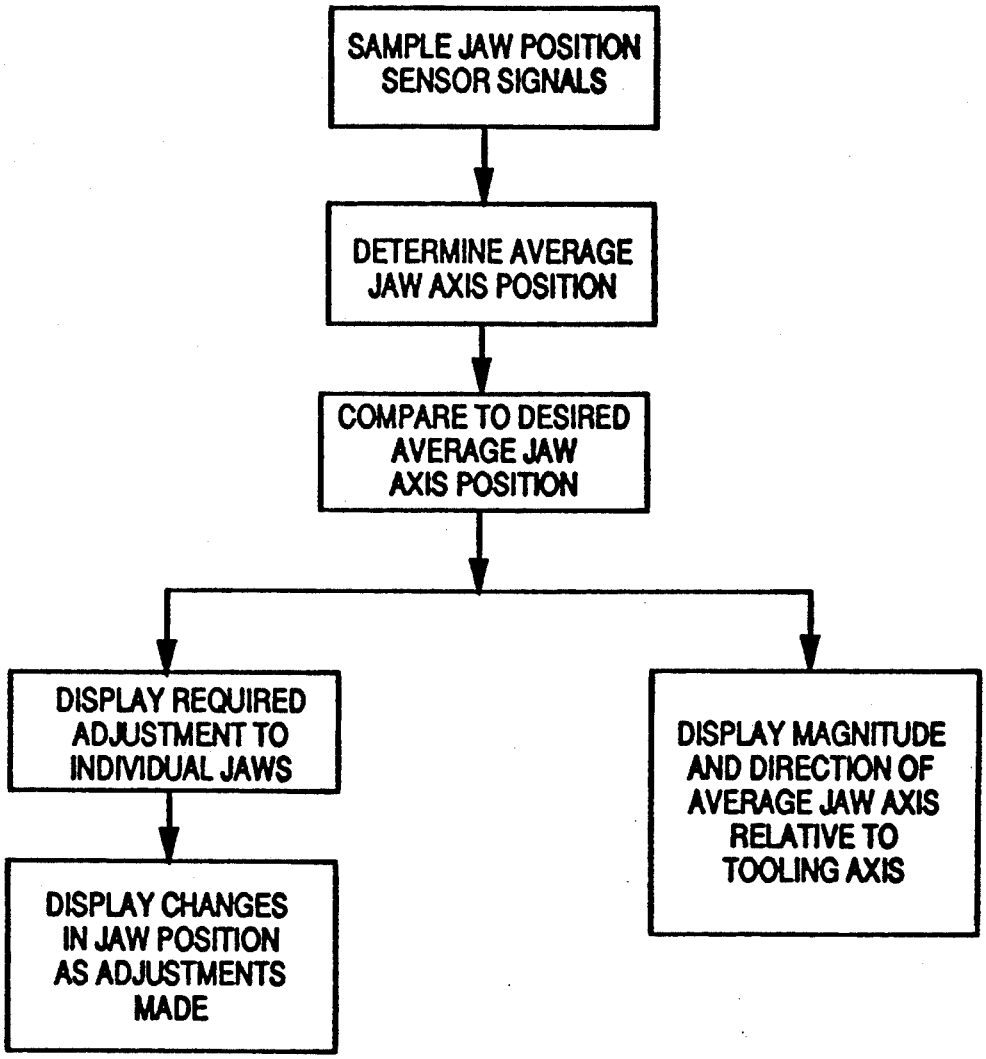
FIG. 4 is a flow chart that illustrates operation of the electronics of FIG. 3 for adjusting the apparatus of the invention.

FIG. 4 illustrates operation of electronics 54 to facilitate set-up and adjustment of apparatus 24. Upon activation, CPU 56 samples and stores the jaw position signals from the several position sensors 50. Based upon such individual jaw position signals, and employing conventional Fourier transform techniques, the position of the average axis of locator jaws 26 is then determined. Such average jaw axis is then compared to a desired jaw axis position set by an operator through keyboard 60. As noted above, such desired position may be either concentric with or eccentric to the axis 64 of the tooling that forms the bolt and/or center-pilot opening in the wheel. The magnitude and direction of any eccentricity between the average and desired axes can then be indicated at display 62. Concurrently or alternatively, display 62 may indicate the adjustment required at the individual jaws 26 to move the average jaw axis to the desired position.

Most preferably, based upon operator input of desired jaw axis position through keyboard 60, CPU 56 operates display 62 to display adjustment needed at each jaw 26 individually and in sequence. For example, display 62 may show that a given jaw must be moved radially inward 0.007 inches. During the adjustment operation as the associated adjustment screw 42 is manipulated by the operator, change of position at cam block 36, and therefore associated jaw 26, is continuously monitored by the associated sensor 50 and displayed to the operator, so that the operator can tell from display 62 when the desired adjustment has been achieved. Through manipulation of keyboard 60, the next jaw adjustment may be displayed. This process is repeated in sequence around the array of jaws until the operator has completed the adjustment.

There has thus been provided an apparatus for forming mounting openings in a vehicle wheel in which the process of adjusting average axis of the bead seats relative to the mounting openings formed in the wheel is greatly facilitated by means of electronically monitoring individual jaw position and displaying necessary adjustment for each jaw to an operator. The apparatus electronics 54 preferably is microprocessor-based. Suitable programming for implementing operation will be self-evident to persons of ordinary skill in the art based upon the description set forth above. In the embodiment of the invention herein disclosed, the individual locator jaws are mechanically adjustable. However, electronic adjustment, by servo motors and lead screws or the like, may be implemented without departing from the scope of the invention in its broadest aspects. Sensors 50 preferably comprise Turck model Bi 5-M18-LU linear inductive sensors, although any number of other inductive and non-inductive sensors could as readily be employed.

I claim:

1. Apparatus for forming at least one mounting opening in a vehicle wheel that includes a rim portion and a disc portion within said rim portion, said apparatus comprising:

a circumferential series of locating means for engaging and locating a rim portion of a wheel, means reciprocable for forming at least one mounting opening on a first axis in the disc portion of a wheel engaged by said locating means, said series of locating means comprising a plurality of said locating means disposed in a circumferential array about said first axis, means for selectively moving said locating means between a first position and a second position radially inward of said first position to engage and fixture the rim portion of a wheel positioned within said locating means, position sensing means including a plurality of sensors each operatively coupled to one of said plurality of locating means for providing an electrical sensor signal as a function of position of the associated said locating means relative to said first axis, and means responsive to said plurality of sensor signals for determining position of a measured average axis of said locating means at said second position of said locating means relative to said first axis.

2. The apparatus et forth in claim 1 further comprising means for adjusting position of said locating means relative to said first axis, and wherein said means responsive to said sensor signals comprises means for displaying changes of position of said at least one locating means relative to said first axis during operation of said adjusting means.

3. The apparatus set forth in claim 2 wherein said means for selectively moving said locating means comprises cam means operatively coupled to said reciprocable means for camming said locating means from said first to said second position upon reciprocation of said reciprocable means, and wherein said means for adjusting position of said locating means relative to said first axis comprising means for adjusting said cam means.

4. The apparatus set forth in claim 3 wherein said means for adjusting said cam means comprises an adjustment screw.

5. The apparatus set forth in claim 1 wherein said means responsive to said sensor signals further comprises means for comparing position of said measured average axis to a desired position.

6. The apparatus set forth in claim 5 wherein said means responsive to said sensor signals further comprises means responsive to said comparing means for displaying a difference between said measured and desired axis positions.

7. The apparatus set forth in claim 5 wherein said means responsive to said sensor signals further comprises means responsive to said comparing means for determining changes in position of said locating means for bringing said measured axis position into coincidence with said desired axis position, and means for displaying said changes in position.

8. The apparatus set forth in claim 7 wherein said means for displaying said changes in position comprises means for selectively displaying said changes for individual locating means.

9. The apparatus set forth in claim 8 further comprising means for adjusting position of each said locating means individually relative to said first axis, and wherein said means for selectively displaying said changes in position includes means responsive to said sensor signals for displaying change of position of each said locating means during operation of the associated said adjusting means.

10. The apparatus set forth in claim 1 wherein said means responsive to said sensor signals further comprises means for displaying position of said measured average axis relative to said first axis.

11. The apparatus set forth in claim 1 wherein said means for selectively moving said locating means comprises a plurality of cam means operatively coupled to said reciprocable means for camming said plurality of locating means simultaneously from said first to said second position of said locating means upon reciprocation of said reciprocable means, said plurality of sensors being mounted on said camming means.

12. The apparatus set forth in claim 11 further comprising means for adjustably positioning each of said cam means relative to said first axis.

13. The apparatus set forth in claim 12 wherein said sensors comprise inductive proximity sensors.

* * * * *